United States Patent [19]

Hammond

[11] 4,142,498

[45] Mar. 6, 1979

[54] FUEL INJECTION PUMP TIMING MECHANISM

[75] Inventor: James T. Hammond, Tremont, Ill.

[73] Assignee: Caterpillar Tractor Co., Peoria, Ill.

[21] Appl. No.: 759,682

[22] Filed: Jan. 17, 1977

[51] Int. Cl.[2] ..... F02M 39/00

[52] U.S. Cl. ..... 123/139 AP

[58] Field of Search ..... 123/139 AP; 64/24, 25; 417/399

[56] References Cited

U.S. PATENT DOCUMENTS

| | | | |
|---|---|---|---|
| 1,463,474 | 7/1923 | Lazier | 123/139 AP |
| 2,775,210 | 12/1956 | Buchmann | 417/499 |
| 3,258,937 | 7/1966 | Kranc et al. | 64/25 |
| 3,601,109 | 8/1971 | Barton et al. | 123/139 AP |
| 3,815,564 | 6/1974 | Suda et al. | 123/139 AP |
| 3,951,118 | 4/1976 | Henson | 123/139 AP |
| 4,019,478 | 4/1977 | Hobo et al. | 123/139 AP |

FOREIGN PATENT DOCUMENTS

| | | | |
|---|---|---|---|
| 185742 | 8/1936 | Switzerland | 123/139 AP |

*Primary Examiner*—Charles T. Jordan

*Attorney, Agent, or Firm*—Wegner, Stellman, McCord, Wiles & Wood

[57] ABSTRACT

An improved fuel pump construction including a driven shaft having cams thereon for actuating a fuel pump for internal combustion engines, a driving shaft adapted to be driven by an engine proportionally to engine speed, the shafts having aligned, splined ends in close adjacency with the lead of the splines on the ends being dissimilar. A splined coupling interconnects the ends and is axially movable thereon and rotatable with the shafts. A collar rotatably receives the coupling and restrains the coupling against axial movement. An adjusting mechanism including a manually and selectively operable actuator is provided for axially adjusting the position of the collar and for holding the collar in a desired position of adjustment. By reason of the dissimilar lead between the splines, movement of the collar, and thus the coupling, will change the angular relationship between the two shafts so that precise timing can be achieved without disassembling the mechanism.

4 Claims, 6 Drawing Figures

FUEL INJECTION PUMP TIMING MECHANISM

BACKGROUND OF THE INVENTION

This invention relates to fuel injection pump timing devices and, more specifically, to such a mechanism including improved means for setting the timing.

Prior art of possible relevance includes the following U.S. Pat. Nos.: Backlund et al. 2,977,778, issued Apr. 4, 1961; Kranc et al. 3,258,937, issued July 5, 1966; and Barton et al. 3,601,109, issued Aug. 24, 1971.

As is well known, in fuel injected, internal combustion engines, the point at which fuel is injected into each cylinder during the operating cycle plays a large part in determining engine output and efficiency. In variable speed engines, means are provided whereby the point in the operating cycle at which injection occurs is advanced as engine speed increased for this purpose. The foregoing prior art patents are representative of mechanisms which accomplish this function.

However, the use of such mechanisms does not ensure optimal timing. For example, if the timing is initially improperly set, even though such mechanisms will perform their intended function of advancing the timing with engine speed, there will remain improper adjustment at all speeds, resulting in inefficiency and lower outputs.

In the case of many prior art mechanisms, achieving proper initial timing is difficult since access to components is extremely limited. Moreover, in many such devices, it is virtually impossible to make adjustments while the engine is running so as to compensate for timing requirements that may vary slightly from one engine to the next even though the engines are ostensibly identical. It is also difficult to adjust timing in many prior art constructions to accommodate variations in timing requirements imposed by differing operating environments.

SUMMARY OF THE INVENTION

It is the principal object of the invention to provide a new and improved timing mechanism for use in fuel injection pump systems for internal combustion engines. More specifically, it is an object of the invention to provide such a timing mechanism wherein the initial adjustment of timing of the fuel pumps is simplified and wherein the adjustment may be made while the engine is operating.

An exemplary embodiment of the invention achieves the foregoing objects in a structure including a driven shaft having means thereon for actuating a fuel pump for an internal combustion engine and a driving shaft adapted to be driven by the engine proportionally to the engine speed. The shafts have aligned, splined ends in close adjacency and the lead of the splines on the ends is dissimilar. A splined coupling interconnects the ends and is axially movable thereon and rotatable with the shafts. A collar rotatably receives the coupling and restrains the coupling against axial movement. Means, including a manually and selectively operable actuator, are provided for axially adjusting the position of the collar and for holding the collar in a desired position of adjustment. The difference in lead in the splined ends results in a change in the angular relation between the two shafts upon axial shifting of the coupling.

The invention contemplates a housing containing the shafts, the couplings and the collar and includes means whereby access to the actuator may be achieved from the exterior of the housing.

In one embodiment, the collar includes a groove in its radially outer surface and the adjusting and holding means includes an element journalled in the housing adjacent the collar with a projection extending into the groove. The projection is offset from the axis of rotation of the element so that rotation of the element and the projection will cause axial shifting of the collar. Preferably, the rotatable element includes an enlarged head extending exteriorly of the housing and the actuator comprises a tool receiving formation in the head. Means are provided for retaining the element assembled to the housing.

According to other embodiments of the invention, the collar includes finger receiving means in its radially outer surface and the adjusting and holding means comprises a movable yoke having proposed fingers in the finger receiving means.

In one embodiment, the yoke is pivotally mounted and the fingers include inwardly directed stub shafts received in the finger receiving means.

In another embodiment, the yoke is axially movable and the adjusting and holding means comprises a threaded shaft parallel to the driving and driven shafts within the housing and mounting the yoke.

The invention also contemplates provision of means for locking the adjusting and holding means against movement in at least some of the embodiments.

Other objects and advantages will become apparent from the following specification taken in connection with the accompanying drawings.

DESCRIPTION OF THE PREFERRED EMBODIMENTS

Figure 1:
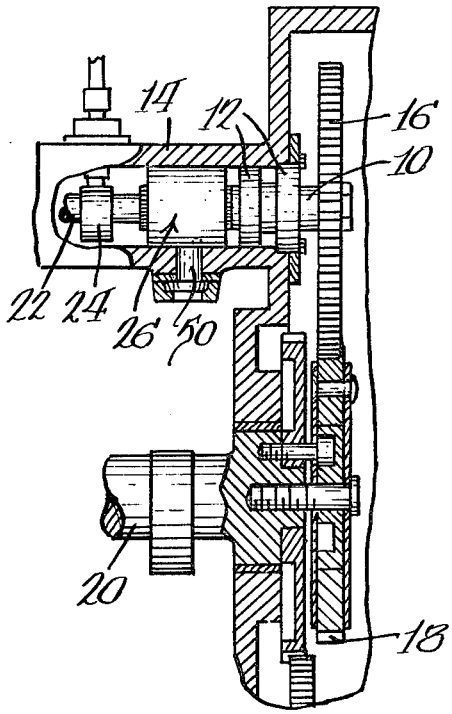
FIG. 1 is a partial sectional view of part of an internal combustion engine including a fuel injection system and embodying the invention.

An exemplary embodiment of the invention is illustrated in FIG. 1 and is seen to include a driving shaft 10 journalled in bearings 12, received in a housing 14. The shaft 10 includes a gear 16 by which it is coupled to a gear 18 which may include timing advancing means made according to the above identified Barton et al. patent. The gear 18 is ultimately driven by the main cam shaft 20 of the engine through the timing advancing means.

Also disposed within the housing 14 is a driven shaft 22 having a plurality of cams 24 thereon. The cams 24 conventionally drive reciprocating fuel injection pumps (not shown) for the various cylinders of the engine with which the system is used. Interconnecting the driving shaft 10 and the driven shaft 22 is a timing adjustment mechanism, generally designated 26, made according to the invention whereby the angular relationship between the shafts 10 and 22 may be readily adjusted to achieve precise timing.

Figure 2:
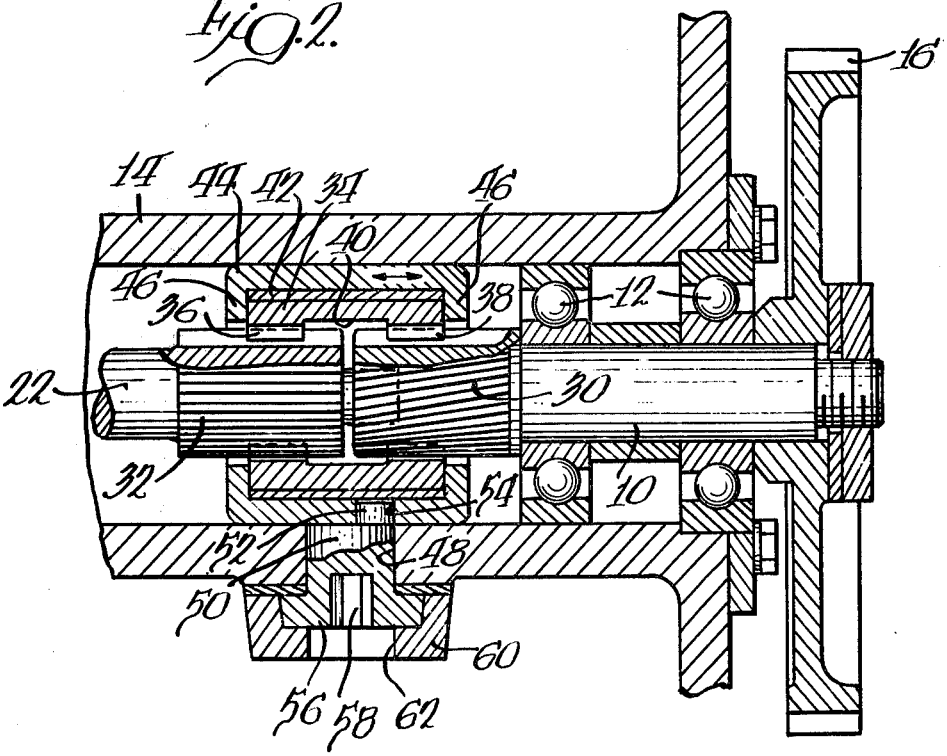
FIG. 2 is an enlarged, fragmentary sectional view of one embodiment of the invention.

Referring to FIG. 2, one embodiment of the mechanism 26 will be described in greater detail. The shaft 10, within the housing, includes a toothed or splined end 30, the teeth on the end 30 having a helical lead. The driven shaft 22 includes a toothed or splined end 32 aligned with the toothed end 30 and in close adjacency thereto. The teeth on the end 32 are illustrated as being axial, but it is to be understood that the precise relationship illustrated is only one of many that may be utilized. It is only necessary that the leads of the teeth on the ends 30 and 32 be dissimilar.

Within the housing 14, there is provided a coupling 34 having a set of radially inwardly directed teeth or splines 36 on one end and radially inwardly directed teeth or splines 38 on its opposite end. The teeth 36 and 38 are separated by a relief 40. The teeth 36 are engaged with the toothed end 32 of the driven shaft 22, while the teeth 38 are in engagement with the toothed end 30 of the driving shaft 10 and it will be appreciated that the coupling 34 thus couples the shafts 10 and 22 together for mutual rotation.

It will also be appreciated that due to the length of the teeth, as illustrated in FIG. 2, the coupling 40 is axially shiftable. It will further be appreciated that due to the dissimilar lead between the teethed ends 30 and 32, axial shifting of the coupling 34 will angularly advance or retard the angular position of the driven shaft 22 with respect to the driving shaft 10.

The coupling 34 is surrounded by a bearing 42 to be rotatably received in a collar 44. The collar 44 includes thrust ends 46 embracing the ends of the coupling 34 and terminating radially outwardly of the toothed ends 30 and 32. As a result, while the coupling 34 is free to rotate relative to the collar 44, it cannot move axially except with the collar 44. In other words, the collar 44 restrains axial movement of the coupling 34.

Adjacent the collar 44, and on one side of the housing 14, there is provided a bore 48 which receives a rotatable cylindrical element 50 to journal the same within the housing 14. Within the housing 14 the rotatable element 50 includes a projection 52 which is cylindrical and which is received in an elongated slot 54 in the radially outer surface of the collar 44. It will be observed from FIG. 2 that the projection 52 is offset from the axis of rotation of the rotatable element 50, that is, offset from the axis of the bore 48.

The rotatable element 50 also includes an enlarged head 56 which is exterior of the housing 14 and includes a tool receiving formation 58 therein. As illustrated, the tool receiving formation 58 is adapted to receive an Allen wrench, but obviously, other configurations could be employed if desired. A cap 60 having an opening 62 in its base through which access to the tool receiving formation 58 can be achieved secures the rotatable element 50 the housing 14 and preferably is such as to exert frictional pressure against the head 56 to prevent the same from rotating except when force is applied thereto through a tool applied to the tool receiving formation 58.

When fuel injection timing is to be set, a tool is introduced into the tool receiving formation 58 and the rotatable element 50 rotated. Because of the eccentric location of the projection 54, rotation of the element 50 will result in axial shifting of the collar 44. When the desired position for the collar is obtained, the tool may be removed and the collar 44 will remain in the desired position of adjustment.

It will be appreciated that the construction, by reason of the provision of the actuator in the form of the tool receiving opening 58 exterior of the housing 14, allows adjustment without requiring the disassembly of the various components and moreover, permits the adjustment to be made while the engine is operating.

Figure 3:
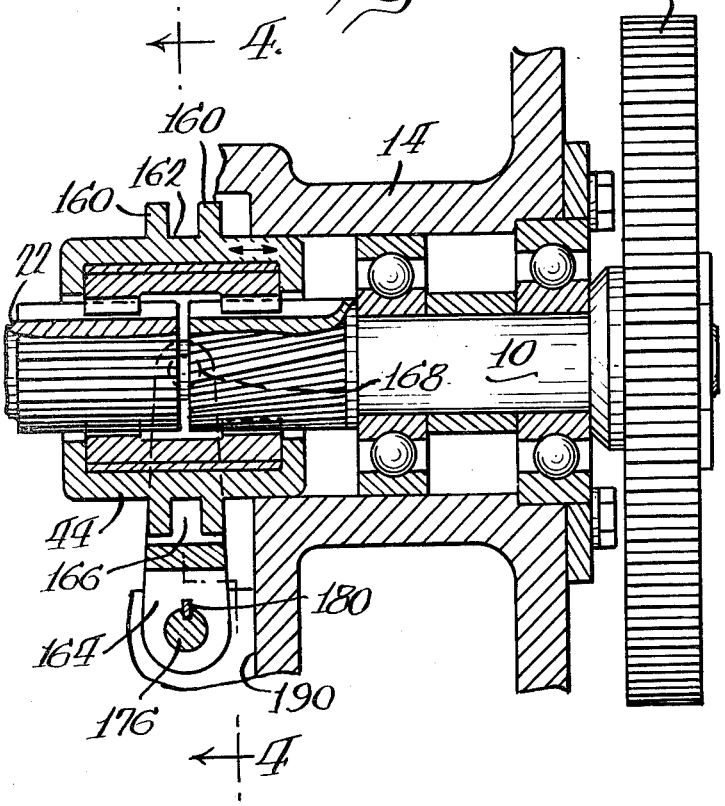
FIG. 3 is an enlarged, sectional view of a modified embodiment of the invention.
Figure 4:
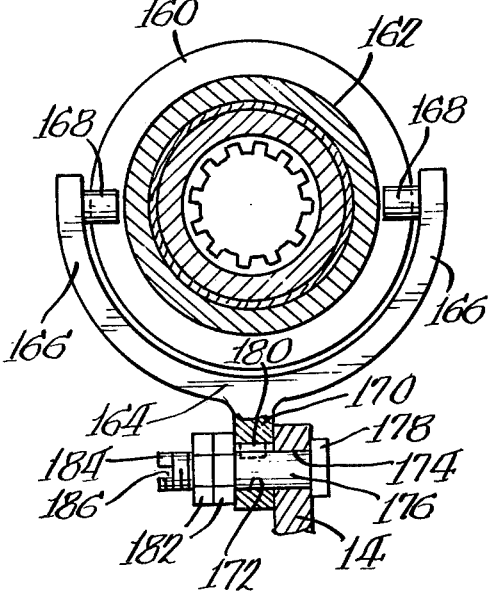
FIG. 4 is a sectional view taken approximately along the line 4—4 in FIG. 3.

FIGS. 3 and 4 illustrate an alternative embodiment and where like components are employed, like reference numerals are used. The principal difference between the embodiment of FIGS. 3 and 4 and that of FIG. 2 resides in the adjusting and holding means for the collar 44 and in the interfacing between the adjusting and holding means and the collar 44. As illustrated in FIG. 3, the collar 44, on its radially outer surface, includes annular lands 160 separated by a groove 162. The housing 14 is altered appropriately so as to receive the lands 60 and allow axial movement of the same therein.

As seen in FIG. 4, there is provided a yoke 164 having opposed fingers 166 which terminate in cylindrical stub shafts 168 which are directed radially inwardly to be received in the groove 162. The bight of the yoke 164 includes an oppositely extending finger 170 having a bore 172 therein. The housing 14 includes an aligned bore 174 which receives a pin 176 having an enlarged head 178 for retention purposes. A key 180 keys the yoke 164 to the pin and a pair of nuts 182 are applied to a threaded end 184 of the pin 176 so as to clamp the finger 172 firmly against the housing 14. The end of the pin 176 opposite from the head 178 includes a slotted formation 186 for receipt of a screwdriver or the like. Consequently, when the nuts 182 are loosened, the pin 176 may be rotated to rotate the yoke about the axis of the pin 176 when a tool is applied to the slot 186. Such rotation will cause the stub shafts 168 to move in an arcuate path spaced from the axis of the pin 176 and by reason of their being received in the groove 162, axial shifting of the collar 44 will result. When the collar 44 is placed in the desired position of adjustment, the tool may be removed from the slot 186 and the nuts 182 tightened to firmly lock the yoke in a desired position of adjustment.

Preferably, the housing 14 is provided with an opening 190 aligned with the axis of the pin 176 and of sufficient size to allow introduction of a screwdriver into the housing to be engaged in the slot 186 and to allow introduction of a socket wrench or the like into the housing for tightening and loosening the nuts 182.

Figure 5:
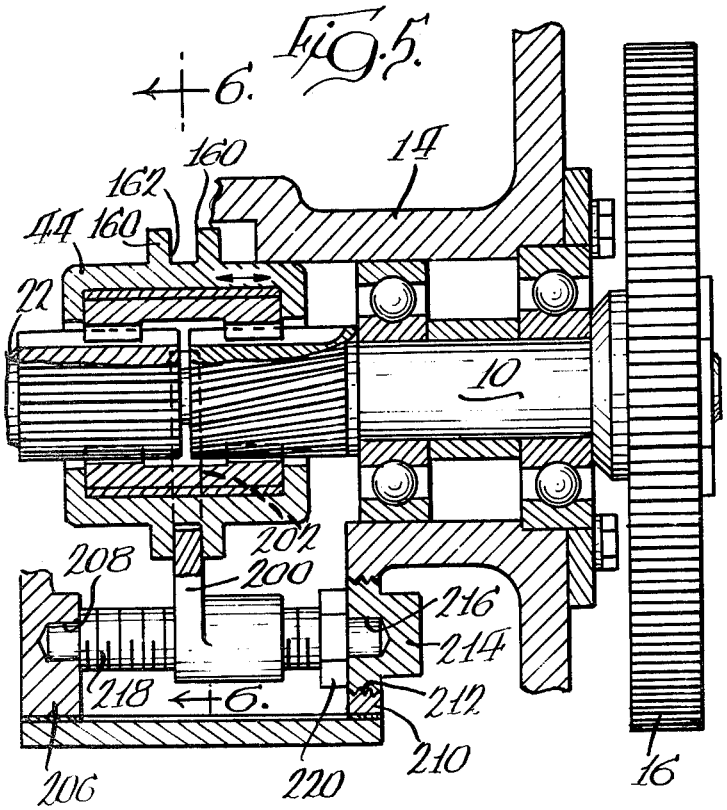
FIG. 5 is an enlarged, fragmentary sectional view of still another embodiment of the invention.
Figure 6:
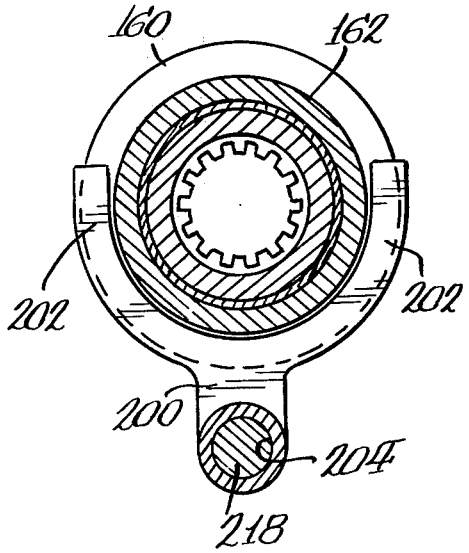
FIG. 6 is a sectional view taken approximately along the line 6—6 of FIG. 5.

FIGS. 5 and 6 illustrate a further embodiment of the invention which is generally similar to that illustrated in FIGS. 3 and 4 except that rather than employing a pivotally mounted yoke, such as the yoke 164, an axially shiftable yoke is employed. The collar 44 retains the lands 160 and the separating groove 162. A yoke 200 includes opposed fingers 202 which are recieved in the groove 162 along the length of the fingers 202. The yoke 200 includes a bore 204, which is threaded, in its base. The housing 14 includes a laterally directed extension 206 having a bore 208 on its interior surface. An opposed, similarly directed extension 210 is spaced from the extension 206 in the direction of the gear 16 and includes an enlarged, threaded bore 212 for receipt of a cap 214. The cap 214 includes an interior bore 216 which is aligned with the bore 208 and the two serve to journal a threaded shaft 218 within the housing 14 in parallel relation to the shafts 10 and 22. The threaded shaft 218 extends through the threaded bore 204 in the base of the yoke 200 and, at its end adjacent to the cap 214, includes an integral hex head 220. Adjustment may be obtained by removing the cap 214 and applying a socket wrench or the like to the head 220 to rotate the threaded shaft 218 in any desired direction. Rotation of the same will cause the yoke 200 to travel one direction or the other between the extensions 206 and 210 of the housing 14 to axially shift the collar 44. When the desired position of adjustment of the collar 44 is obtained, the tool may be removed and the cap 214 reapplied. Inadvertent rotation of the threaded shaft 218 may be avoided by advancing the cap 214 sufficiently into the bore 212 to tightly frictionally engage a side of the head 220.

From the foregoing, it will be appreciated that a mechanism made according to the invention permits easy adjustment of initial timing of fuel injection systems and does not require disassembly of involved components to achieve the same. It will also be appreciated that the invention allows ready adjustment of timing during engine operation because the adjustments can be made without partial or entire disassembly thereby enabling a mechanic to "fine tune" the injection portion of the cycle for optimal engine efficiency in a variety of operating conditions, and to minimize noxious emissions.

The embodiments of the invention in which an exclusive property or privilege is claimed are defined as follows:

1. In a fuel pump construction, the combination of:

a driven shaft having means thereof for actuating a fuel pump for an internal combustion engine;

a driving shaft adapted to be driven by an engine proportionally to engine speed;

said shafts having aligned, toothed ends in close adjacency, the lead of the teeth on said ends being dissimilar;

a toothed coupling interconnecting said ends and axially movable thereon and rotatable with said shafts;

a collar rotatably receiving said coupling and restraining said coupling against axial movement;

means, including a manually and selectively operable actuator, for axially adjusting the position of said collar and for holding said collar in a desired position of adjustment;

a housing containing said shafts, coupling and collar;

means whereby access to said actuator may be achieved from the exterior of said housing;

a groove in the radially outer surface of said collar; and said adjusting and holding means comprises an element journalled in said housing adjacent said collar with a projection extending into said groove, said projection being offset from the axis of rotation of said element.

2. The fuel pump construction of claim 1 wherein said element includes an enlarged head exteriorly of said housing, said actuator comprises a tool receiving formation in said head, and means for retaining said element assembled to said housing.

3. In a fuel pump construction, the combination of:

a driven shaft having means thereof for actuating a fuel pump for an internal combustion engine;

a driving shaft adapted to be driven by an engine proportionally to engine speed;

said shafts having aligned, toothed ends in close adjacency, the lead of the teeth on said ends being dissimilar;

a toothed coupling interconnecting said ends and axially movable thereon and rotatable with said shafts;

a collar rotatably receiving said coupling and restraining said coupling against axial movement;

means, including a manually and selectively operable actuator, for axially adjusting the position of said collar and for holding said collar in a desired position of adjustment;

a housing containing said shafts, coupling and collar;

means whereby access to said actuator may be achieved from the exterior of said housing;

said collar including finger receiving means in its radially outer surface and said adjusting and holding means comprising a rotatable element;

a movable yoke having opposed fingers in said finger receiving means and splined to said element to pivot therewith;

a tool receiving formation in said element; and means for locking said element against rotation.

4. In a fuel pump construction, the combination of:

a driven shaft having means thereof for actuating a fuel pump for an internal combustion engine;

a driving shaft adapted to be driven by an engine proportionally to engine speed;

said shafts having aligned, toothed ends in close adjacency, the lead of the teeth on said ends being dissimilar;

a toothed coupling interconnecting said ends and axially movable thereon and rotatable with said shafts;

a collar rotatably receiving said coupling and restraining said coupling against axial movement;

means, including a manually and selectively operable actuator, for axially adjusting the position of said collar and for holding said collar in a desired position of adjustment;

a housing containing said shafts, coupling and collar;

means whereby access to said actuator may be achieved from the exterior of said housing;

said collar including finger receiving means in its radially outer surface and said adjusting and holding means comprising a movable yoke having opposed fingers in said finger receiving means, said yoke being axially movable, said adjusting and holding means further comprising a threaded shaft parallel to said driving and driven shafts and within said housing and mounting said yoke, and a tool receiving formation on said threaded shaft; and said access achieving means comprising an opening in said housing aligned with the axis of said threaded shaft and a removable plug for said opening, said plug receiving an end of said threaded shaft to hold the same within said housing.

* * * * *